US006086186A

United States Patent [19]

Bergman et al.

[11] Patent Number: 6,086,186

[45] Date of Patent: Jul. 11, 2000

[54] APPARATUS FOR POSITIONING A CONTROL ELECTRODE ARRAY IN A DIRECT ELECTROSTATIC PRINTING DEVICE

[75] Inventors: Karin V. Bergman; Anders G. P. Ingelhag, both of Göteborg, Sweden

[73] Assignee: Array Printers AB, Vastra Frolunda, Sweden

[21] Appl. No.: 08/994,149

[22] Filed: Dec. 19, 1997

[51] Int. Cl.[7] ..... B41J 2/04

[52] U.S. Cl. ..... 347/55

[58] Field of Search ..... 347/55, 40, 12, 347/54, 120, 124, 151, 141, 77, 82, 157, 115; 399/271, 290, 293, 294, 295, 297, 298, 302, 308

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 4426333 | 11/1969 | Japan . |
| 5555878 | 4/1980 | Japan . |
| 5584671 | 6/1980 | Japan . |
| 5587563 | 7/1980 | Japan . |
| 56-89576 | 7/1981 | Japan . |
| 58044457 | 3/1983 | Japan . |
| 58-155967 | 9/1983 | Japan . |
| 62-248662 | 10/1987 | Japan . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—John E. Barlow, Jr.
*Assistant Examiner*—Raquel Yvette Gordon
*Attorney, Agent, or Firm*—Knobbe, Martens, Olson & Bear, LLP

[57] ABSTRACT

An image recording apparatus includes at least one print station and an image receiving medium caused to move in relation to the print station. The print station includes a particle source for delivering charged particles in a position adjacent to a printhead structure interposed between the particle source and the image receiving medium. The printhead structure has a first surface facing the particle source, a second surface facing the image receiving medium, and a plurality of apertures arranged through the printhead structure. Aperture controllers are arranged in conjunction with the apertures to modulate streams of charged particles from the particle source through the apertures toward the image receiving medium. Depression areas are arranged on the first surface of the printhead structure in such a configuration that each aperture is arranged in a depression area. The part of the aperture facing the particle source is sunken with respect to the first surface of the printhead structure. The depression areas help maintain a uniformity in the thickness of a toner layer on the particle source.

18 Claims, 10 Drawing Sheets

U.S. PATENT DOCUMENTS

| | | |
|---|---|---|
| 3,815,145 | 6/1974 | Tisch et al. . |
| 4,263,601 | 4/1981 | Nishimura et al. . |
| 4,274,100 | 6/1981 | Pond . |
| 4,353,080 | 10/1982 | Cross . |
| 4,382,263 | 5/1983 | Fischbeck et al. . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fijii et al. . |
| 4,498,090 | 2/1985 | Honda et al. . |
| 4,511,907 | 4/1985 | Fukuchi . |
| 4,525,727 | 6/1985 | Kohashi et al. . |
| 4,571,601 | 2/1986 | Teshima . |
| 4,675,703 | 6/1987 | Fotland . |
| 4,717,926 | 1/1988 | Hotomi . |
| 4,743,926 | 5/1988 | Schmidlin et al. . |
| 4,748,453 | 5/1988 | Lin et al. . |
| 4,814,796 | 3/1989 | Schmidlin . |
| 4,831,394 | 5/1989 | Ochiai et al. . |
| 4,860,036 | 8/1989 | Schmidlin . |
| 4,903,050 | 2/1990 | Schmidlin . |
| 4,912,489 | 3/1990 | Schmidlin . |
| 5,028,812 | 7/1991 | Bartky . |
| 5,036,341 | 7/1991 | Larsson . |
| 5,038,159 | 8/1991 | Schmidlin et al. . |
| 5,057,855 | 10/1991 | Damouth . |
| 5,072,235 | 12/1991 | Slowik et al. . |
| 5,083,137 | 1/1992 | Badyal et al. . |
| 5,095,322 | 3/1992 | Fletcher . |
| 5,121,144 | 6/1992 | Larson et al. . |
| 5,128,695 | 7/1992 | Maeda . |
| 5,148,595 | 9/1992 | Doggett et al. . |
| 5,170,185 | 12/1992 | Takemura et al. . |
| 5,181,050 | 1/1993 | Bibl et al. . |
| 5,204,696 | 4/1993 | Schmidlin et al. . |
| 5,204,697 | 4/1993 | Schmidlin . |
| 5,214,451 | 5/1993 | Schmidlin et al. . |
| 5,229,794 | 7/1993 | Honman et al. . |
| 5,235,354 | 8/1993 | Larson . |
| 5,237,346 | 8/1993 | Da Costa et al. . |
| 5,256,246 | 10/1993 | Kitamura . |
| 5,257,045 | 10/1993 | Bergen et al. . |
| 5,270,729 | 12/1993 | Stearns . |
| 5,274,401 | 12/1993 | Doggett et al. . |
| 5,307,092 | 4/1994 | Larson . |
| 5,329,307 | 7/1994 | Takemura et al. . |
| 5,374,949 | 12/1994 | Wada et al. . |
| 5,386,225 | 1/1995 | Shibata . |
| 5,402,158 | 3/1995 | Larson . |
| 5,414,500 | 5/1995 | Furukawa . |
| 5,446,478 | 8/1995 | Larson . |
| 5,450,115 | 9/1995 | Bergen et al. . |
| 5,453,768 | 9/1995 | Schmidlin . |
| 5,473,352 | 12/1995 | Ishida . |
| 5,477,246 | 12/1995 | Hirabayashi et al. . |
| 5,477,250 | 12/1995 | Larson . |
| 5,506,666 | 4/1996 | Masuda et al. . |
| 5,508,723 | 4/1996 | Maeda . |
| 5,515,084 | 5/1996 | Larson . |
| 5,526,029 | 6/1996 | Larson et al. . |
| 5,558,969 | 9/1996 | Uyttendaele et al. . |
| 5,559,586 | 9/1996 | Wada . |
| 5,600,355 | 2/1997 | Wada . |
| 5,614,932 | 3/1997 | Kagayama . |
| 5,617,129 | 4/1997 | Chizuk, Jr. et al. . |
| 5,625,392 | 4/1997 | Maeda . |
| 5,640,185 | 6/1997 | Kagayama . |
| 5,650,809 | 7/1997 | Kitamura . |
| 5,666,147 | 9/1997 | Larson . |
| 5,677,717 | 10/1997 | Ohashi . |
| 5,708,464 | 1/1998 | Desie . |
| 5,774,159 | 6/1998 | Larson . |
| 5,805,185 | 9/1998 | Kondo . |
| 5,818,480 | 10/1998 | Bern et al. . |
| 5,818,490 | 10/1998 | Larson . |
| 5,847,733 | 12/1998 | Bern . |

FOREIGN PATENT DOCUMENTS

| | | |
|---|---|---|
| 62-13356 | 11/1987 | Japan . |
| 01120354 | 5/1989 | Japan . |
| 05220963 | 8/1990 | Japan . |
| 04189554 | 8/1992 | Japan . |
| 4-2689591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |

APPARATUS FOR POSITIONING A CONTROL ELECTRODE ARRAY IN A DIRECT ELECTROSTATIC PRINTING DEVICE

BACKGROUND OF THE INVENTION

1. Field of the Invention

The present invention is within the field of electrographical printing devices. More specifically, the invention relates to an improvement to position a control electrode array in cooperation with a particle source to enhance the printing quality of direct electrostatic printers.

2. Description of the Related Art

Of the various electrostatic printing techniques, the most familiar and widely utilized is that of xerography, wherein latent electrostatic images formed on a charge retentive surface, such as a roller, are developed by a toner material to render the images visible, the images being subsequently transferred to plain paper. This process is called an indirect printing process since the images are first formed on an intermediate photoreceptor and then transferred to paper surface.

Another form of electrostatic printing is known as direct electrostatic printing (DEP). Many of the methods used in DEP, such as particle charging, particle transport, and particle fusing are similar to those used in xerography. However, DEP differs from xerography in that an electric field is generated by electrical signals to cause toner particles to be deposited directly onto plain paper to form visible images without the need for those signals to be intermediately converted to another form of energy. The novel feature of the DEP concept is the simultaneous field imaging and toner transport to produce visible images directly onto plain paper or any suitable image receiving medium.

U.S. Pat. No. 5,036,341 granted to Larson discloses a DEP printing device and a method to produce text and pictures with toner particles on an image receiving substrate directly from computer generated signals. The Larson patent discloses a method which positions a control electrode array between a back electrode and a rotating particle carrier. An image receiving substrate, such as paper, is then positioned between the back electrode and the control electrode array.

An electrostatic field on the back electrode attracts the toner particles from the surface of the toner carrier to create a particle stream toward the back electrode. The particle stream is modulated by voltage sources which apply an electric potential to selected individual control electrodes to create electrostatic fields which either permit or restrict the transport of toner particles from the particle carrier through the control electrode array. In effect, these electrostatic fields "open" or "close" selected apertures in the control electrode array to the passage of toner particles by influencing the attractive force from the back electrode. The modulated stream of charged toner particles allowed to pass through the opened apertures impinges upon a print-receiving medium interposed in the particle stream to provide line-by-line scan printing to form a visible image.

The control electrode array of the above-mentioned patent may take on many designs, such as a lattice of intersecting wires arranged in rows and columns, or a screen-shaped, apertured printed circuit. Generally, the array is formed of a thin substrate of electrically insulating material provided with a plurality of apertures. Each aperture is surrounded by an individually addressable control electrode, and a corresponding voltage source is connected thereto to attract the charged toner particles from the particle carrier to the image receiving substrate by applying voltage signals in accordance with the image information. For example, the control electrode array may be constructed of a flexible, non-rigid material and overlaid with a printed circuit such that apertures in the material are arranged in several rows and surrounded by electrodes. Regardless of the design or the material of construction, it is essential to maintain a constant, uniform gap distance between the control electrode array and the toner layer on the surface of the particle carrier.

The actual gap between the toner layer and the control electrode array can vary from machine to machine because the gap is determined by a combination of independent factors such as manufacturing variations in the size and placement of the particle carrier and the control electrode array, as well as the thickness of the toner layer on the particle carrier.

In addition to minimizing distance variations in the gap between the control electrode array and the particle carrier, it is also important to maintain a smooth uniform toner layer thickness on the particle carrier. Typically, the diameter of an individual toner particle is on the order of 10 microns, with a toner layer on the particle carrier being approximately 30–40 microns thick.

U.S. Pat. No. 5,666,147, also granted to Larson, discloses improved means for maintaining a constant minimal gap between the control electrode array and the particle carrier, while providing a uniform toner layer on the surface of the particle carrier. According to that patent, a spacer is mounted on the array on the side facing the particle carrier to engage the carrier on it, and the portion of the array supporting the spacer can move slightly radially towards and away from the carrier to accommodate imperfections in the carrier surface and variations in the toner layer thickness. The gap distance is thus maintained at a constant value according to the thickness of the spacer, independent of the thickness of the particle layer.

Further, to ensure entire coverage of the print area, the apertures are preferably aligned in several parallel rows arranged in a slight angle to each other, such that each aperture corresponds to a specific addressable area on the information carrier. Since the control electrodes are disposed around the apertures, the release area, i.e., the surface of the toner layer influenced by an individual control electrode, is larger than the aperture diameter. Since toner particles are supplied consecutively to the different rows, an overlap between the release areas of two adjacent rows will cause the toner supply to decrease from row to row. This defect, known as "toner starvation," causes a degradation of the print uniformity due to density variations between dots printed through different rows. Such a defect may cause print surfaces intended to be homogeneously covered by pigment to appear to be striped periodically in the direction of paper motion (white line noise).

In order to further reduce undesired distance variations of the gap between the control electrode array and the particle carrier, while providing a uniform toner supply to several aperture rows successively, there is still a need for improved means for positioning the control electrode array in relation to the particle source.

SUMMARY OF THE INVENTION

The present invention satisfies a need for an improved method for accurately positioning a printhead structure in cooperation with a particle source having a outer surface caused to move in relation to the printhead structure.

The present invention also satisfies a need for providing a uniform supply of charged particles to several rows of apertures in a printhead structure, notwithstanding the actual position of a row with respect to the motion of the outer surface of the particle source, thereby eliminating the defect referred to above as toner starvation.

The present invention further satisfies a need for providing a uniformly thick layer of charged particles on the outer surface of the particle source, from which layer an intended amount of charged particles are allowed to be released upon passage over each single aperture.

The present invention relates to an image recording apparatus including at least one print station and an image receiving medium caused to move in relation to the print station. The print station includes a particle source for delivering charged particles in a position adjacent to a printhead structure interposed between the particle source and the image receiving medium. The printhead Structure has a first surface facing the particle source, a second surface facing the image receiving medium, and a plurality of apertures arranged through the printhead structure. Aperture controllers are arranged in conjunction with the apertures to modulate streams of charged particles from the particle source through the apertures toward the image receiving medium. Depression areas are arranged on the first surface of the printhead structure in such a configuration that each aperture is arranged in a depression area. The part of the aperture facing the particle source is thereby sunken with respect to the first surface of the printhead structure.

According to a preferred embodiment, the particle source has an outer surface caused to move in relation to the printhead structure in a predetermined first direction. The apertures, arranged through the printhead structure, are aligned in several parallel rows extending in a predetermined second direction which is preferably perpendicular to the first direction. The depression areas have a length L in the first direction, a width W in the second direction, and a depth D in a third direction, perpendicular to both the first direction and the second direction.

The depression length L is larger than the extension the apertures in the first direction. The depression width W is substantially equal to the extension of the apertures in the second direction. The depression depth D throughout the depression area determines a gap distance between the apertures and the first surface of the printhead structure. The gap distance can be substantially constant along the depression length L (trench-shaped depression) or can be variable along the depression length or across the depression width, For example, the gap distance can decrease in the first direction (ramp-shaped depression).

The apertures have a central axis in the third direction through the thickness of the printhead structure, and have a cross section perpendicular to the central axis. The cross section has a first extension in the first direction and a second extension in the second direction. For example, the apertures have a circular cross section which is constant along the central axis (cylindrical apertures). Alternatively, the apertures may have a circular cross section which continuously varies along the central axis (conical apertures) or which varies stepwise along the central axis. The apertures may even have an elliptical cross section, a rectangular cross section, or any other suitable cross section. Each row of apertures has a downstream side and an upstream side with respect to the motion of the outer surface of the particle source. A depression area is arranged in relation to each aperture and extends preferably on the downstream side of the corresponding row. The depression length L is larger than the first extension of the aperture, and the depression width W is preferably equal to or slightly larger than the second extension of the aperture. At least a portion of each aperture is located in a depression area and is thus sunken with respect to a plane of the first surface of the printhead structure. The outer surface of the particle source is coated with charged particles. The outer surface is positioned in relation to the printhead structure in such a manner that a portion of the outer surface is pressed against the first surface of the printhead structure so as to convey the charged particles in frictional contact with the first surface of the printhead stricture. As a result, only charged particles facing a depression area are allowed to be released from the outer surface of the particle source while the remaining charged particles are maintained in contact with the first surface of the printhead structure. Accordingly, the amount of charged particles that can be influenced by a particular aperture, i.e., the release area of the aperture, has an extension which does not exceed the extension of the depression area associated to that aperture. Thereby, charged particles intended to be supplied to any particular row remain unaffected when passing between apertures located on the upstream side of that row.

In a preferred embodiment of the present invention, the printhead structure is formed of a substrate layer overlaid with a spacer layer having a first surface facing the particle source and having a plurality of depression areas arranged on the first surface in the spacer layer thickness. The spacer layer is a thin layer of a material having a low-friction coefficient to permit an efficient transport of charged particles thereon.

BRIEF DESCRIPTION OF THE DRAWINGS

These and other objects, specific advantages, and features of the present invention will become more apparent upon a reading of the following detailed description of specific examples and embodiments thereof, when read in conjunction with an examination of the accompanying drawings, wherein like reference numerals designate like parts throughout. The dimensions in the drawings are not to scale.

DETAILED DESCRIPTION OF THE PREFERRED EMBODIMENTS

Figure 1:
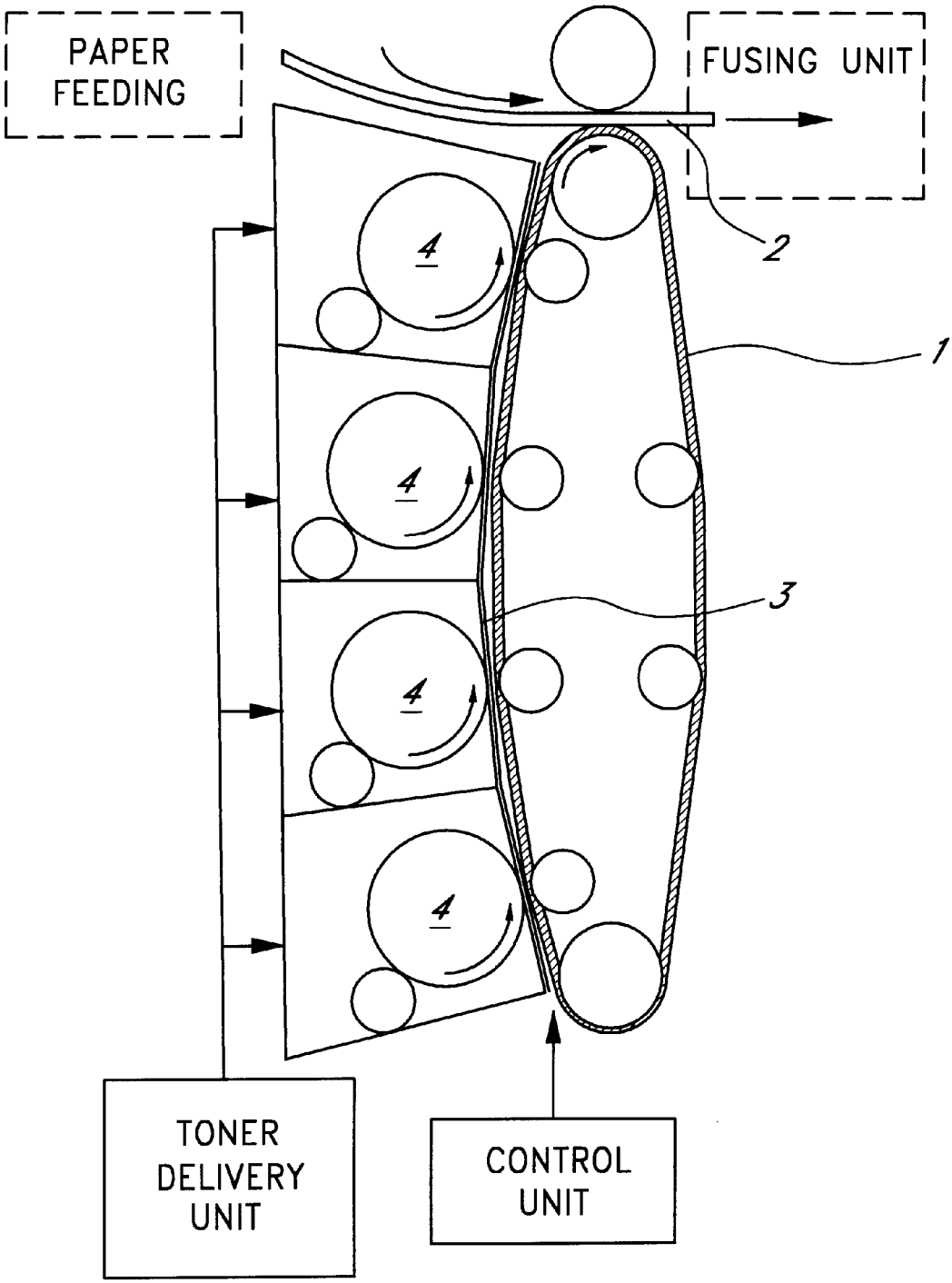
FIG. 1 is a schematic section view across a direct printing apparatus according to a preferred embodiment of the present invention.

The present invention relates to an image recording apparatus such as that schematically illustrated in FIG. 1, in which an intermediate image receiving member, such as a transfer belt 1, is conveyed successively past four print stations, each corresponding to a specific toner color (generally yellow, cyan, magenta and black), to intercept a modulated stream of toner particles from each print station whereby the so obtained four image configurations are directly superposed onto the transfer belt 1, forming a visible full color toner image which is subsequently transferred onto an information carrier 2 delivered from a paper feeding unit. Each of the print stations includes a toner particle delivery unit having a particle source 4 disposed adjacent to the transfer belt 1. A printhead structure 3, such as an apertured electrode matrix, is arranged between the particle source 4 and the transfer belt 1 and is connected to a control unit for modulating the stream of toner particles from the particle source 4. The toner image thus formed onto the transfer belt 1 is brought into contact with an information carrier 2, whereas the toner image is transferred to the information carrier 2 and thereafter made permanent in a fusing unit.

Figure 2B:
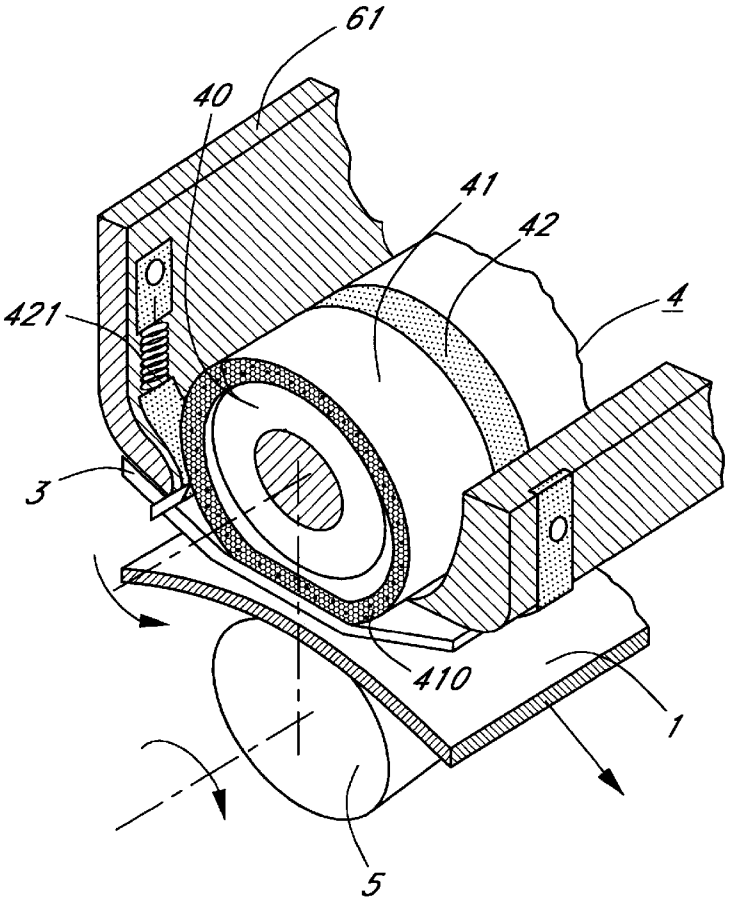
FIG. 2*b* is a perspective view of a part of the print station shown in FIG. 2*a*.
Figure 2A:
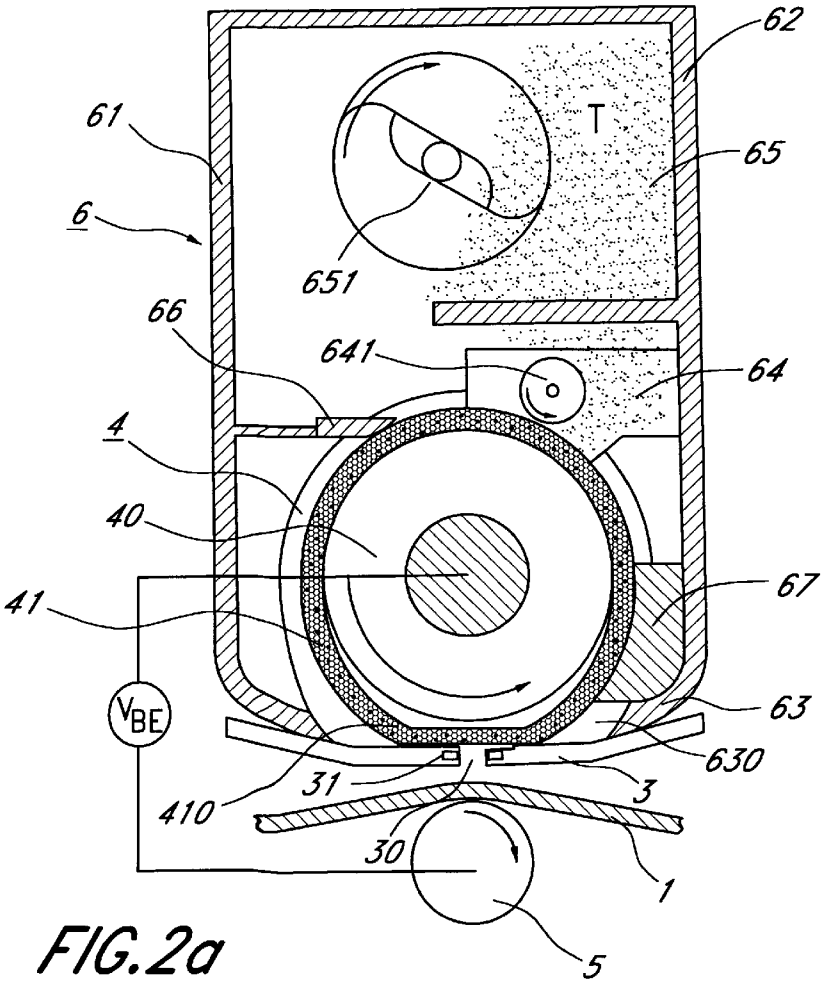
FIG. 2*a* is a schematic section view across a print station included in the apparatus shown in FIG. 1.

As shown in FIG. 2*a*, a background voltage source produces an electric potential difference $V_{BE}$ between the particle source 4 arid a back electrode roller 5 supporting the transfer belt 1 to create an attraction field which enables toner transport from the particle source 4 toward the back electrode roller 5. The printhead structure 3 is interposed in the attraction field between the particle source 4 and the transfer belt 1 for modulating the toner stream produced therebetween. The printhead structure 3 is preferably formed of a flexible, electrically insulating substrate provided with a plurality of apertures 30 each of which is surrounded with a control electrode 31 connected the control unit (not shown), which due to control in accordance with the image information, supplies electrostatic control fields which open or close the corresponding aperture 30, thereby permitting or restricting toner transport through the aperture 30. The toner particles allowed to pass through selected opened apertures are accelerated toward the transfer belt 1 under influence of the attraction field from the back electrode roller 5.

As shown in FIG. 2*a*, a print station in accordance with a preferred embodiment of the present invention includes a toner delivery unit 6 having a pair of side walls 61, 62, front and rear walls (not shown) and a bottom portion 63 facing the printhead structure 3. The bottom portion 63 has an elongated slot 630 extending across the print station from the front wall to the rear wall, such that the apertures 30 of the printhead structure 3 are arranged in the elongated slot 630. The toner delivery unit 6 further includes a rotating drive roller 40, having a rotation axis extending across the print station from the front wall to the rear wall. A bendable developer sleeve 41 has an inner surface brought into frictional contact with a portion of the peripheral surface of the drive roller 40. The developer sleeve 41 is formed of a flexible, seamless belt having a inner surface which is slightly larger than the peripheral surface of the drive roller 40 so as to provide a loosening portion 410 overlying a portion of the printhead structure 3 in the extended slot 630.

As is more apparent from FIG. 2*b*, pressure guides 42 are arranged in contact with the outer surface of the developer sleeve 41 to ensure contact between the inner surface of the developer sleeve 41 and a portion of the peripheral surface of the drive roller 40, thereby providing the loosening portion 410 between the drive roller 40 and the printhead structure 3. The pressure guides 42 are preferably fastened to the side walls 61, 62 in the vicinity of the front and rear walls (not shown) and are arranged to apply a uniform pressure on the part of the developer sleeve 41 faced away from the extended slot 630. The pressure guides 42 are preferably made of a resiliently deformable material or are provided with a pressure regulating element (e.g., a spring) 421 to ensure uniform pressure distribution.

As is apparent from FIG. 2*a*, the toner delivery unit 6 further comprises a buffer chamber 64, a toner supply chamber 65, a toner supply member 641 arranged in the buffer chamber 64, and a toner stirring member 651 arranged in the toner supply chamber 65. The drive roller 40 and the toner supply member 641 are rotated in a first direction by a drive motor (not shown) whereby the developer sleeve 41 is rotated in the first direction by a frictional force between the inner surface of the developer sleeve 41 and the drive roller 40. The toner stirring member 651 is rotated in the opposite direction by the drive motor (not shown). Toner particles T are transferred to the buffer chamber 64 from the toner supply chamber 65 by the rotation of the toner stirring member 651 and are thereafter supplied to the outer surface of the developer sleeve 41 by the rotation of the toner supply member 641. Toner particles are triboelectrically charged to a first polarity, opposite to the back electrode potential $V_{BE}$, by frictional interaction with a toner layer restricting blade 66. The thickness of the toner layer is controlled by the pressure applied by the toner layer restricting blade 66. The toner layer is supplied to the loosening portion 410 of the developer sleeve 41 confronting the printhead structure 3. The toner delivery unit 6 further includes a toner charge erasing member 67 brought into contact with the developer sleeve 41 in a position downstream of the extended slot 630 with respect to the rotation direction of the developer sleeve 41 to remove residual toner from the outer surface of the developer sleeve 41 after passage over the extended slot 630.

Figure 3A:
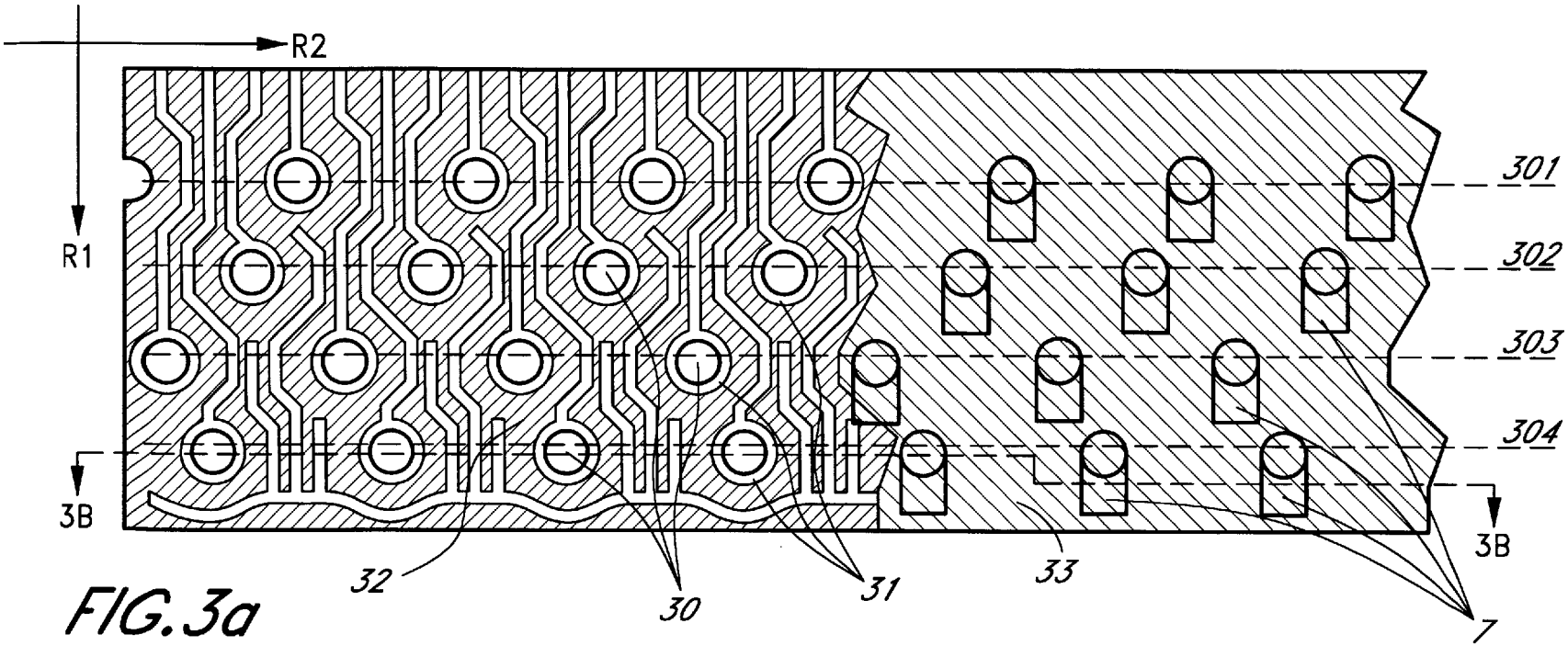
FIG. 3*a* is a plan view of a part of a printhead structure according to a first embodiment of the invention.
Figure 3B:
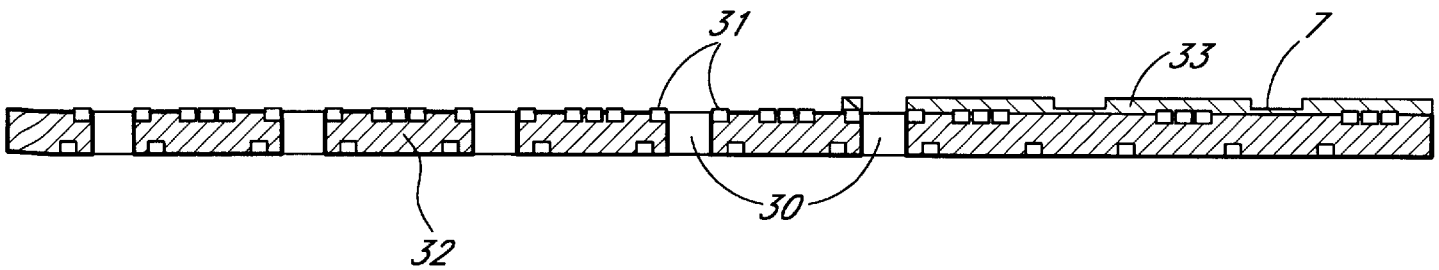
FIG. 3*b* is a section view of the printhead structure taken across the section line 3*b*–3*b* of FIG. 3*a*.

As illustrated schematically in FIG. 3*a* and FIG. 3*b*, a printhead structure 3 in accordance with the present invention is preferably formed of a substrate layer 32 of electrically insulating material, such as polyimide or the like, having a first surface facing the developer sleeve and having a second surface facing the image receiving member. The first surface is overlaid with a printed circuit which includes aperture controllers (i.e., a control means). A spacer layer 33 is arranged on the first surface of the substrate layer to space the substrate layer 32 from the loosening portion 410 of the developer sleeve 41. The printhead structure 3 has a first, longitudinal direction (R1) parallel to the motion of the image receiving medium, and a second, transversal direction (R2) perpendicular to the motion of the image receiving medium. A plurality of apertures 30 arranged through the printhead structure are aligned in several parallel rows 301, 302, 303, 304 extending in the transversal direction (R2). The rows are slightly shifted from one another to ensure entire transverse coverage of the image receiving medium. The printed circuit arranged on the first surface of the substrate layer 32 includes a plurality of control electrodes 31 each of which at least partially surrounds an aperture 30. The control electrodes 31 are individually connected to variable voltage sources arranged in the control unit (not shown). The spacer layer 33 has a first surface facing the developer sleeve 41. The first surface is provided with small depression areas 7 in which a surface is sunken in relation to the first surface of the spacer layer 33. Each depression area 7 has a length in the longitudinal direction (R1), a width in transversal direction (R2) and a predetermined depth with respect to the first surface of the spacer layer 33. Preferably, a depression area extends on the downstream side of each aperture with respect to the motion of the developer sleeve 41 (i.e., in the direction R1 in FIG. 3*a* and FIG. 4*a*).

Figure 4A:
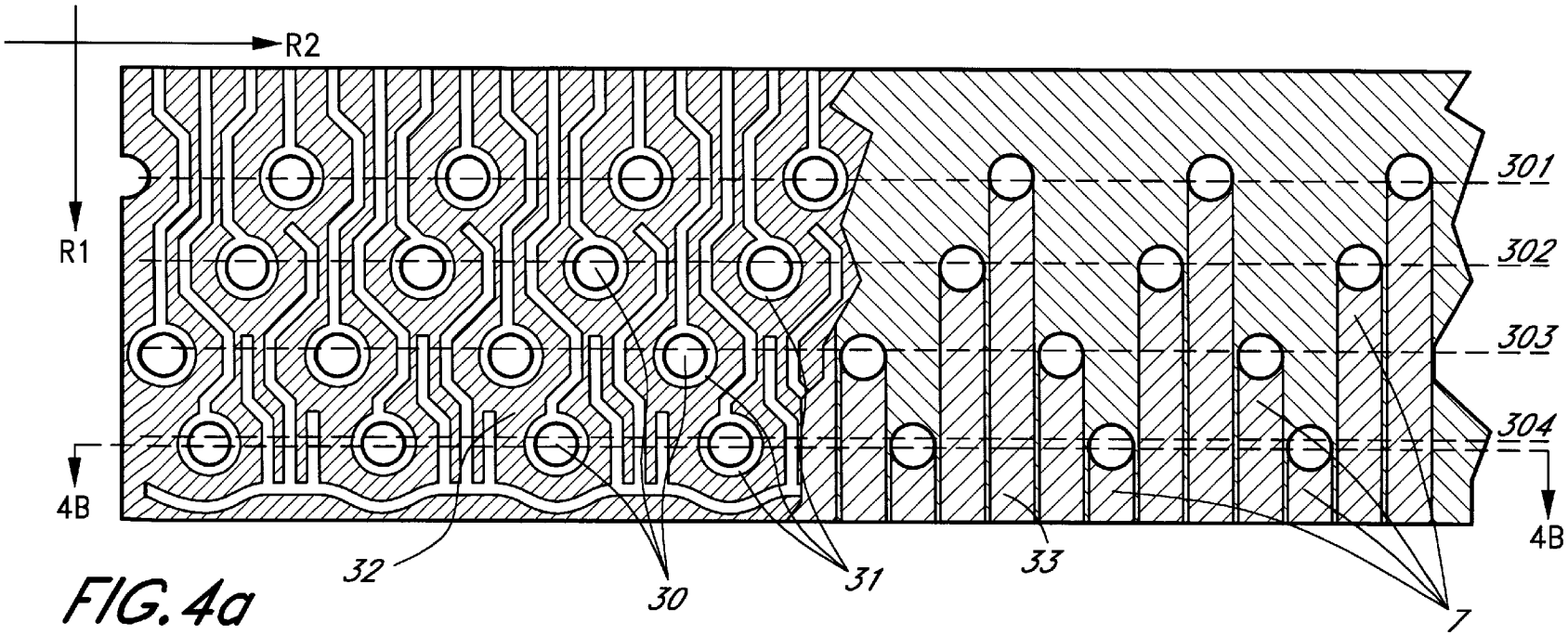
FIG. 4*a* is a plan view of a part of a printhead structure according to a second embodiment of the invention.
Figure 4B:
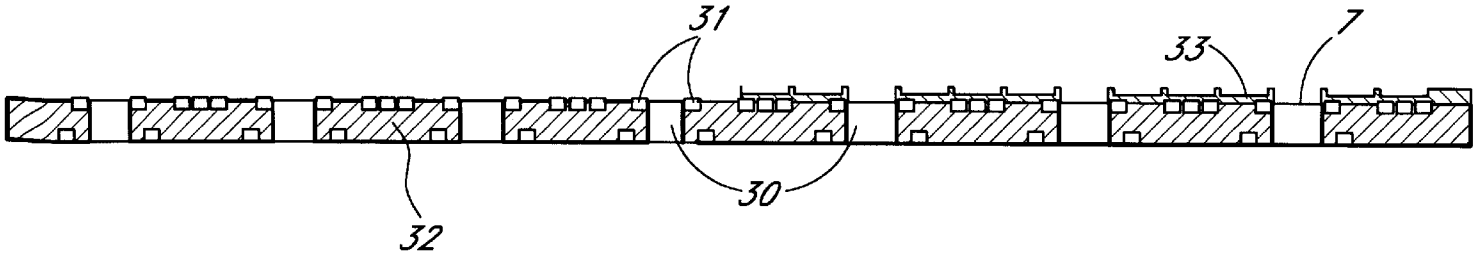
FIG. 4*b* is a section view of the printhead structure taken across the section line 4*b*–4*b* of FIG. 4*a*.

FIG. 4*a* and FIG. 4*b* show another embodiment of a printhead structure in which the depression areas 7 extend over the whole downstream side of each aperture 30 such that adjacent apertures 30 are separated by a portion of the first surface of the spacer layer 33. As it is apparent from FIG. 4*a*, assuming that a toner layer is conveyed in the first direction R1 over the spacer layer 33, the regions of the spacer layer 33 located between the apertures of the first row 301 will support a part of the toner layer intended to be supplied to the following rows 302, 303, 304, thus restricting the release area corresponding to the first row 301. Similarly, the region of the spacer layer 33 located between the apertures of the second row 302 will support toner to be conveyed to the third and fourth rows 303, 304, and so on. Accordingly, a toner layer can be successively conveyed to the different rows 301, 302, 303, 304 while preventing a successive depletion of the toner supply.

Figures 5A, 5B:
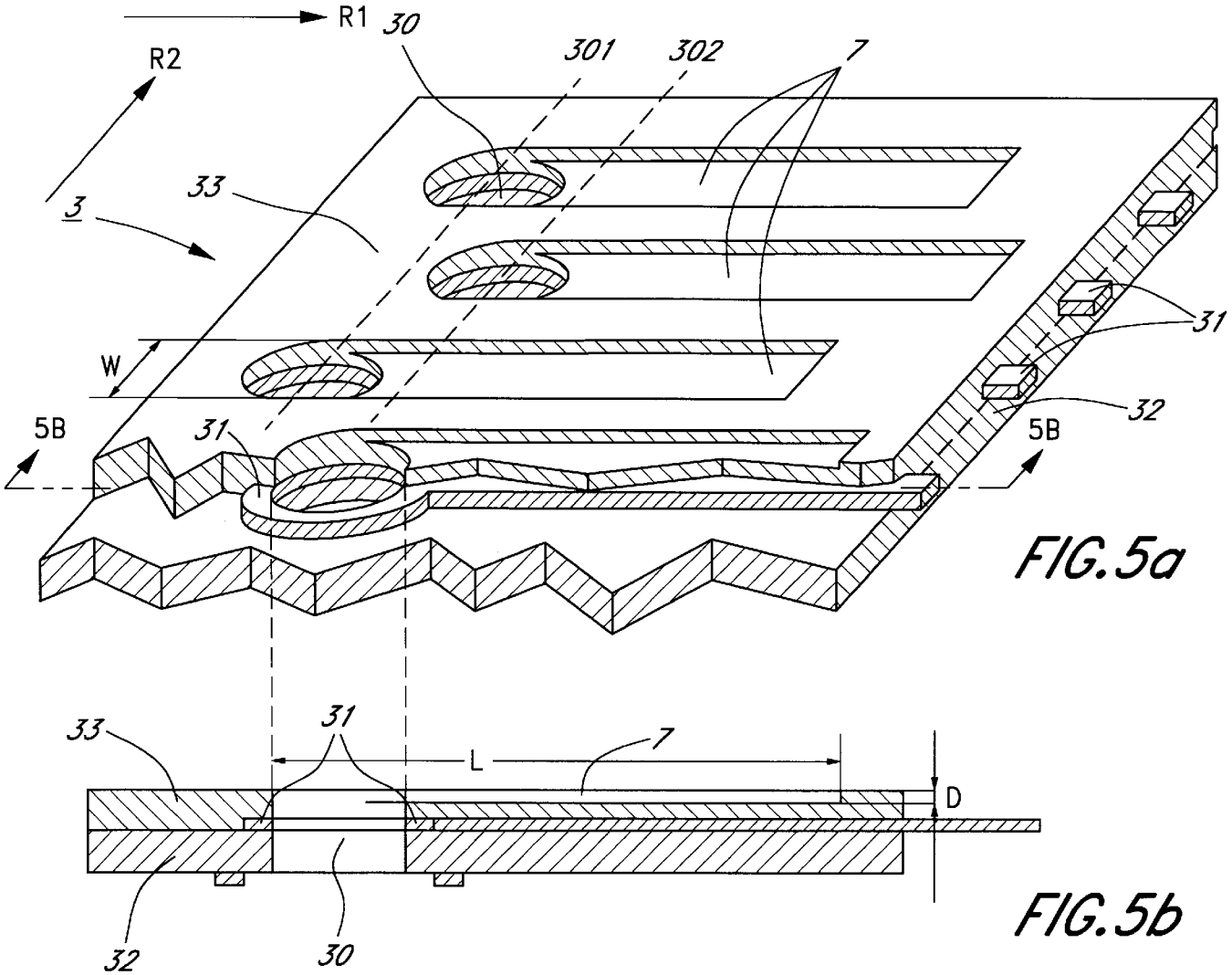
FIG. 5*a* is a perspective view of a part of a printhead structure.
FIG. 5*b* is a section view of the printhead structure shown in FIG. 5*a* taken across the section line 5*b*–5*b* in FIG. 5*a*.

As illustrated in FIG. 5*a* and FIG. 5*b*, the apertures 30 are arranged in several parallel rows extending transversally (R2) across the printhead structure. The apertures 30 have a substantially circular shape with a transverse diameter equal to or smaller than a transverse extension of the corresponding depression area 7. Each aperture 30 has a circumference with a first segment located upstream of the transverse diameter with respect to the motion of the developer sleeve, and a second segment, located downstream, disposed in a sunken region of the depression area 7. Charged particles conveyed on both transverse sides of any particular aperture 30 remain in contact with the first surface of the spacer layer 33. Each of the depression areas 7 has a width W chosen to be substantially equal to an aperture diameter (for example, on the order of 150 microns), a length L larger than the aperture diameter (for example, on the order of 500 to 5000 microns), and a depth D from a plane of the first surface of the spacer layer 33 (for example, in the range of 2 to 10 microns). In the printhead structure shown in FIG. 5*a*, each row of apertures extends along a transverse axis 301, 302 of the printhead structure 3, and the depression areas 7 extend longitudinally on a downstream side of the corresponding row 301, 302 with respect to the motion of the developer sleeve (i.e., in the direction R1). As a result, the toner layer confronts the spacer layer 33 until it reaches the first segment of the aperture circumference, such that the portion of the toner layer allowed to be released from the developer sleeve 41 has a transverse extension which does not exceed the transverse diameter of the aperture.

Figure 6:
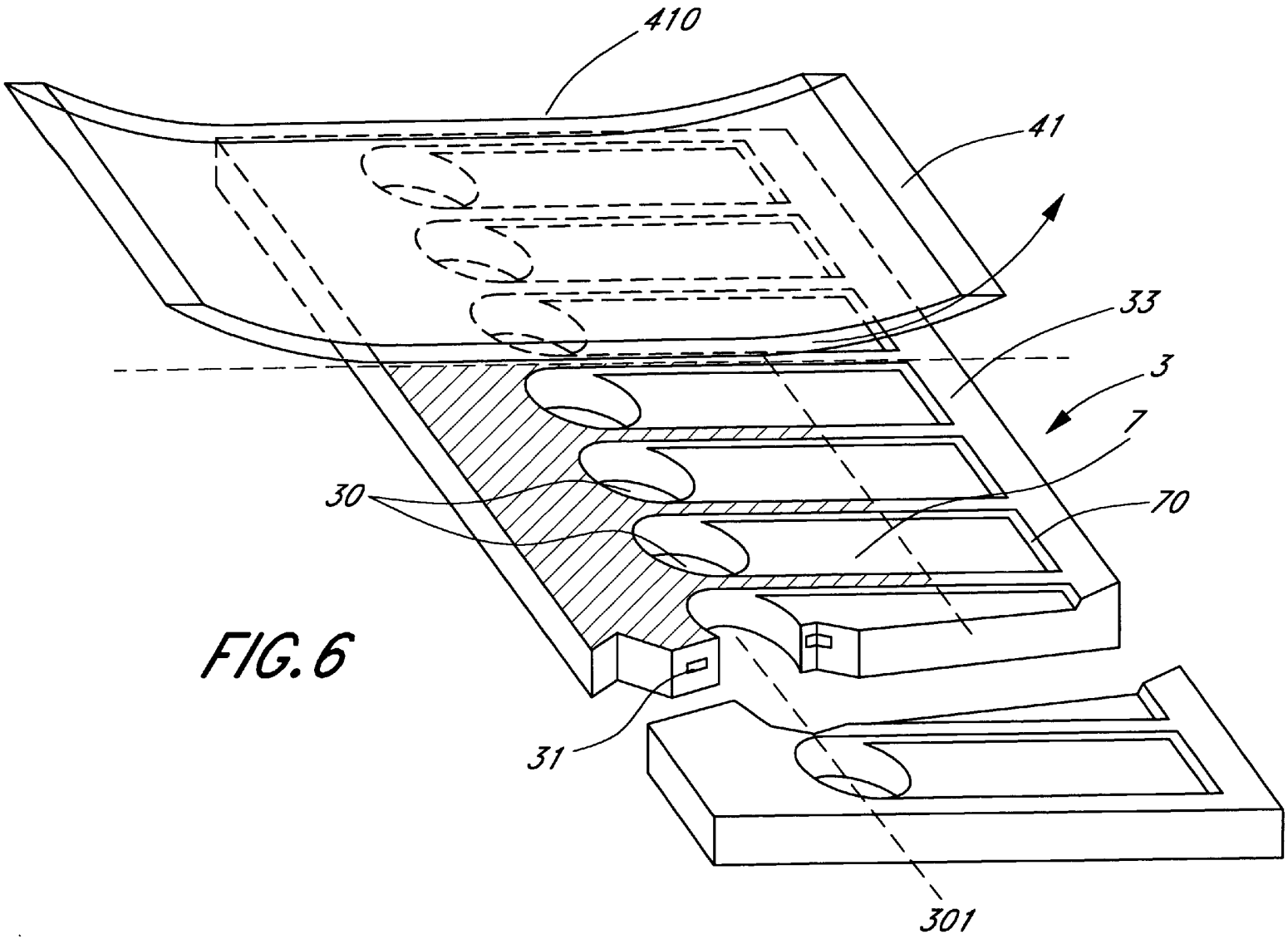
FIG. 6 is a perspective view of a print zone shoving a part of a printhead structure and a part of a developer sleeve, illustrating the relative position therebetween.
Figure 7:
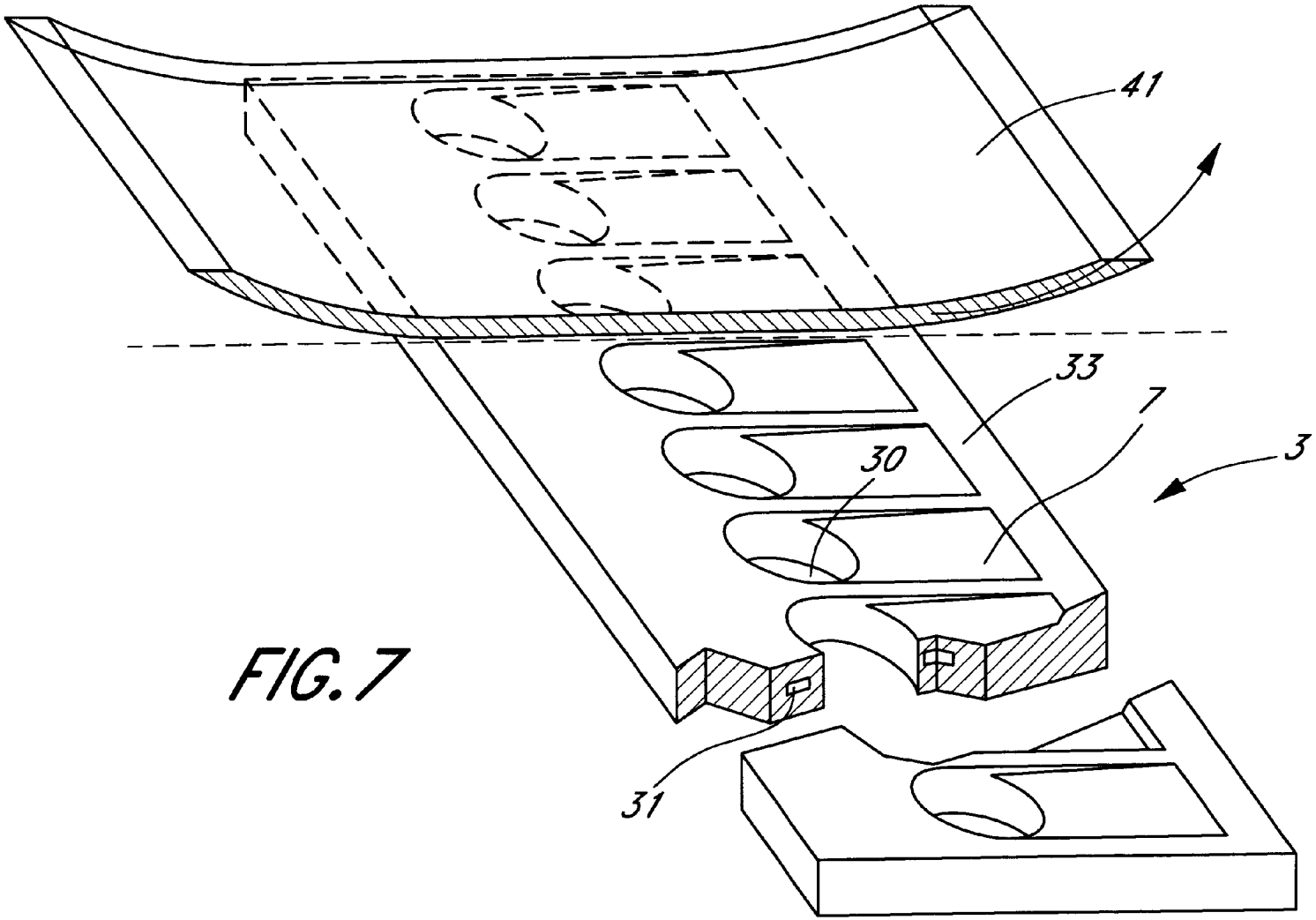
FIG. 7 is an alternate embodiment of the print zone of FIG. 6.
Figure 8A:
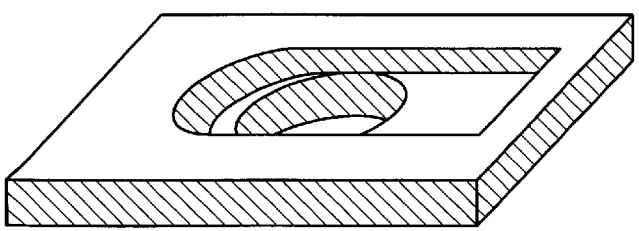
FIGS. 8*a*, 8*b*, 8*c*, 8*d*, 8*e*, 8*f*, 8*g*, 8*h*, 8*i*, 8*j*, 8*k*, 8*l* are perspective views of apertures through printhead structures according to alternate embodiments of the present invention.
Figure 8B:
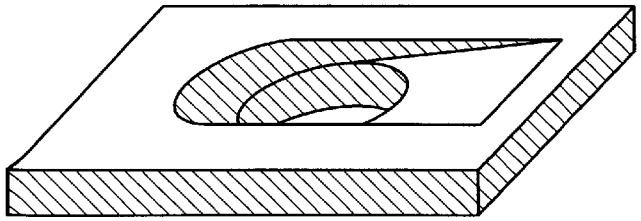
Figure 8C:
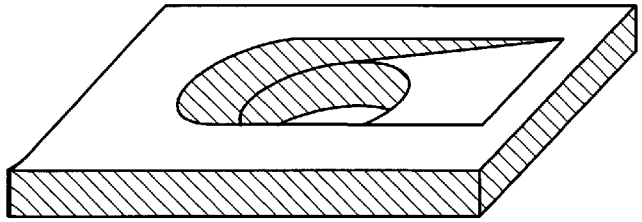
Figure 8D:
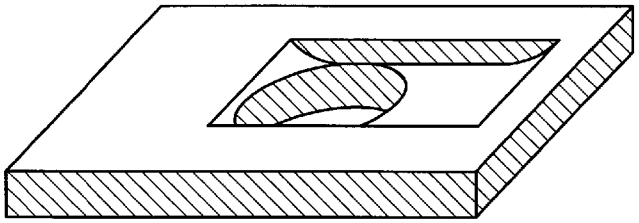
Figure 8E:
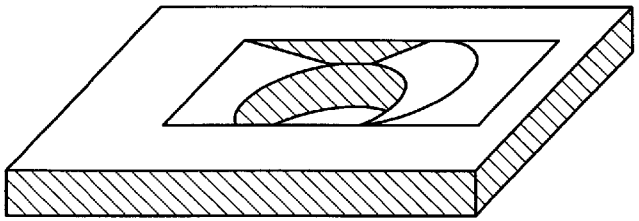
Figure 8F:
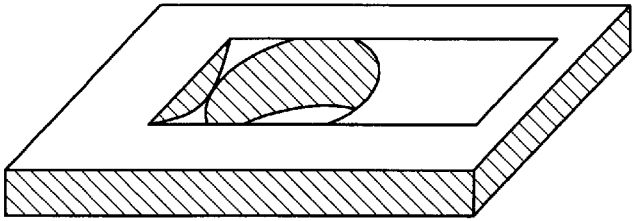
Figure 8J:
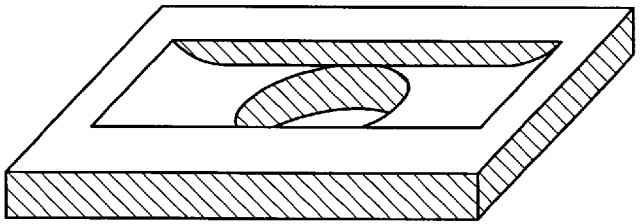
Figure 8K:
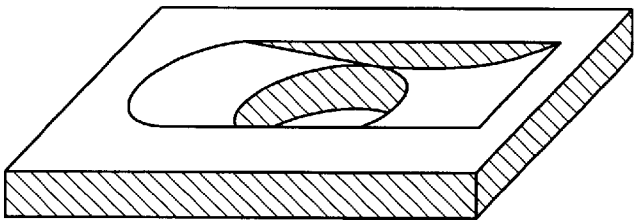
Figure 8L:
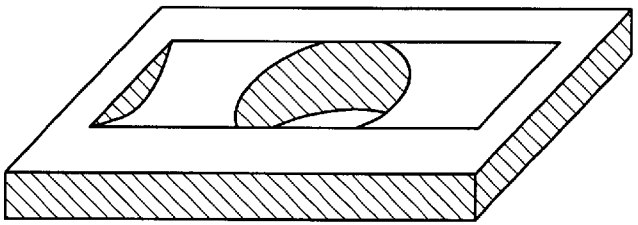
Figure 8G:
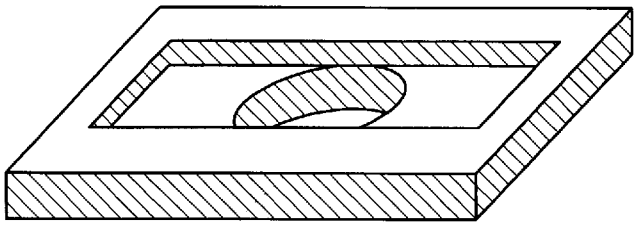
Figure 8H:
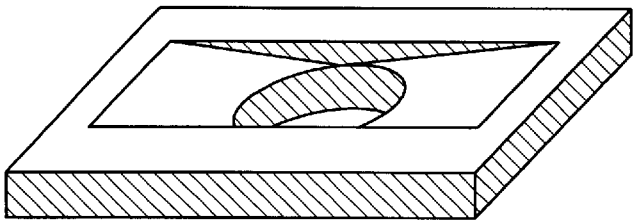
Figure 8I:
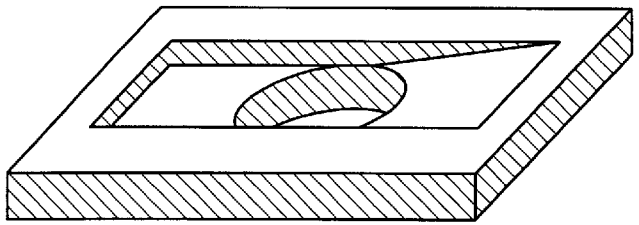

As shown in FIG. 6, a portion of the spacer layer 33 is maintained in direct contact with the toner layer conveyed by the loosening portion 410 of the developer sleeve 41. The contact surface (dashed area in FIG. 6) on the spacer layer 33 extends preferably on the upstream side and on both transverse sides of each aperture 30. Each depression area 7 extends preferably on the downstream side of the aperture row 301 and is sufficiently long to ensure no contact between the toner layer and a transverse edge 70 of the depression area 7, thereby preventing the toner layer from being scraped off by the transverse edge 70. According, to this embodiment, the contact surface of the spacer layer 33 (the dashed area in FIG. 6) extends over the entire row 301, apart from the downstream side of each aperture 30. According to an alternate embodiment shown in FIG. 7, each depression area 7 has a depth which decreases in the downstream direction R1 (for example, a ramp-shaped depression as shown in FIG. 7) so as to avoid any sharp edge against which the toner layer could be scraped off. In both cases, the depression width is chosen to be substantially equal to the aperture diameter for providing a contact area between neighboring apertures, thereby minimizing toner starvation.

Figure 9B:
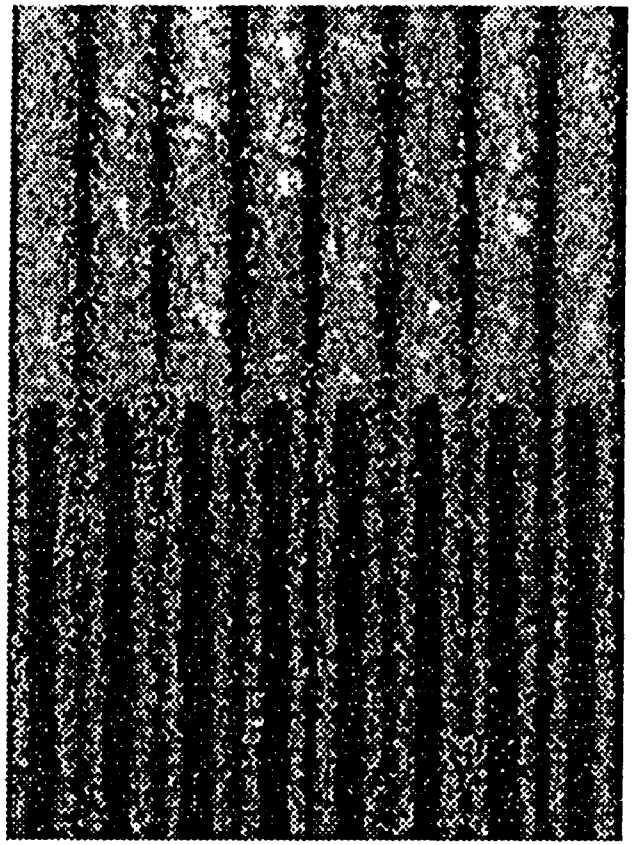
Fig.9b(prior art)
FIG. 9*b* shows a similar print pattern performed in accordance with prior art.
Figure 9A:
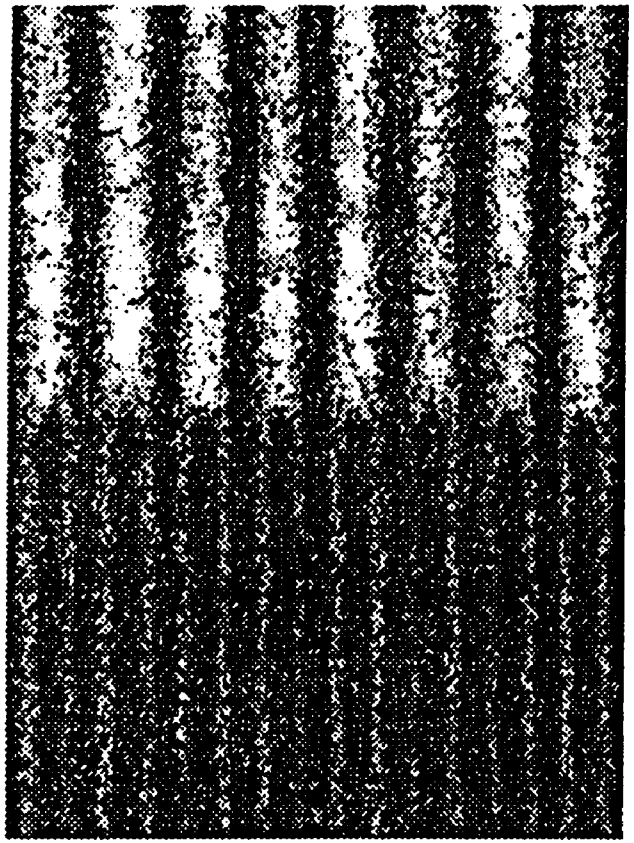
FIG. 9*a* is a print pattern performed in accordance with the present invention.

Accordingly, the release area corresponding to a particular aperture 30 of a first row 301 is restricted by the spacer layer 33 on both transverse sides of the aperture 30, whereby the amount of toner further supplied to an aperture of the next row remains unaffected during passage over the first row. The design of the spacer layer can be accurately adapted to eliminate toner starvation and to ensure a uniform toner delivery to each aperture, notwithstanding its row position. This result is illustrated in FIG. 9*a* and FIG. 9*b*, showing a test pattern in which parallel lines are printed longitudinally, i.e., parallel to the developer sleeve motion, utilizing two different aperture rows located upstream and downstream relative to the developer sleeve motion, respectively, and wherein every second aperture is located in the downstream row (row 2). The first portion of the print pattern is performed utilizing only the apertures of row 2, and the second portion of the print pattern is achieved utilizing both rows. The print pattern of FIG. 9*a* is developed through a printhead structure in accordance with the present invention, while the print pattern of FIG. 9*b* is made through a prior art printhead structure without a spacer layer. As is apparent in FIG. 9*b*, the lines printed through row 2 have a initial width in the first portion and become narrower as soon as row 1 is activated because since row 1 influences a part of the toner to be supplied to row 2 (toner starvation). In the print pattern of FIG. 9*a*, that defect appears to be eliminated as each line printed through row 2 has a substantially constant width along both portion of the print pattern, each line of the second portion also having substantially the same width.

Similar tests can obviously be accomplished utilizing more than two rows, for example utilizing four rows in a configuration such as the configuration shown in the printhead structure of FIG. 3*a*.

As would be easily recognized by a person skilled in the art of direct electrostatic printing, a printhead structure in accordance with the present invention can take on many designs, the above described embodiments being given only as an illustration to clarify a basic concept of the invention. For example, the shape and the depth of the depression areas 7 can be accurately controlled to meet the requirements of high resolution printing. The depression areas are preferably obtained utilizing excimer laser micromachining methods in which UV radiation is delivered on the first surface of the printhead structure at a repetition rate up to approximately one hundred Hz, whereby the incident energy is absorbed in a thin layer (e.g., 0.1 $\mu$m) which is rapidly decomposed, heated and ablated. Each incident laser pulse removes a well-defined thin layer of material so that depth control of the depression area can be very exact. One of the main advantages of excimer laser micromachining techniques is that the techniques can be used in a mask projection mode to transfer a complex pattern onto the workpiece, allowing exact shape control of the depression areas.

Alternate embodiments of the formation of depression areas in the surface of a printhead structure are illustrated in FIGS. 8*a*–8*l*

From the foregoing, it will be recognized that numerous variations and modifications may be effected without departing from the scope of the invention as defined in the appended claims.

What is claimed is:

1. An image recording apparatus which comprises:

at least one print station and an image receiving medium caused to move in relation to the print station, said print station including a particle source for delivering charged particles in a position adjacent to a printhead structure interposed between the particle source and the image receiving medium, said printhead structure comprising:

a first surface facing the particle source;

a second surface facing the image receiving medium;

a plurality of apertures arranged through the printhead structure; and aperture controllers arranged in conjunction with the apertures to modulate streams of charged particles from the particle source through the apertures toward the image receiving medium, wherein:

a part of the particle source is arranged adjacent to the first surface of the printhead structure; and depression areas are arranged into the first surface of the printhead structure such that at least a portion of each aperture is arranged in a depression area, said portion of the aperture being sunken with respect to a surrounding region of the first surface of the printhead structure and thereby spaced from the part of the particle source arranged adjacent to the first surface of the printhead structure.

2. An image recording apparatus as defined in claim 1, wherein the particle source has an outer surface caused to move in relation to the printhead structure in a predetermined first direction, and wherein a length of the depression areas in said first direction is larger than an extension of the apertures in said first direction.

3. An image recording apparatus as defined in claim 1, wherein the particle source has an outer surface caused to move in relation to the printhead structure in a predetermined first direction, and wherein a width of the depression areas in a second direction perpendicular to said first direction is substantially equal to an extension of the apertures in said second direction.

4. An image recording apparatus as defined in claim 1, wherein the particle source has an outer surface caused to move in relation to the printhead structure in a predetermined first direction, and wherein said outer surface of the particle source is coated with a particle layer brought in frictional contact with the first surface of the printhead structure and is spaced from the apertures over the depression areas.

5. An image recording apparatus as defined in claim 1, wherein the particle source has an outer surface caused to move in relation to the printhead structure in a predetermined first direction, wherein the apertures are arranged in at least one row extending in a predetermined second direction, preferably perpendicular to said first direction, and wherein at least a part of each depression area extends on a downstream side of the row with respect to the motion of the outer surface of the particle source.

6. An image recording apparatus as defined in claim 1, wherein the particle source has an outer surface caused to move in relation to the printhead structure in a predetermined first direction, and wherein a depth of the depression areas with respect to the first surface of the printhead structure decreases in said first direction from a maximum value proximate an aperture to a lower value in a part of the depression area located on a downstream side of said aperture with respect to the motion of the outer surface of the particle source.

7. An image recording apparatus as defined in claim 1, wherein the particle source has an outer surface caused to move in relation to the printhead structure in a predetermined first direction, and wherein a depth of the depression areas, with respect to the first surface of the printhead structure, is substantially constant in said first direction.

8. An image recording apparatus as defined in claim 1, wherein the particle source has an outer surface coated with a layer of charged particle, said outer surface of the particle source being caused to move in relation to the printhead structure in a predetermined first direction, and wherein a portion of said outer surface of the particle source extends substantially parallel to the first surface of the printhead structure in such a position that the layer of charged particles is pressed against the first surface of the printhead structure, whereby only charged particles located in front of a depression area are allowed to be released from the outer surface of the particle sources.

9. An image recording apparatus as defined in claim 8, wherein the portion of the outer surface of the particle source extending substantially parallel to the first surface of the printhead structure extends over only a part of the depression areas.

10. An image recording apparatus including at least one print station and an image receiving medium caused to move in relation to the print station, said print station including a particle source for delivering charged particles in a position adjacent to a printhead structure interposed between the particle source and the image receiving medium, said printhead structure comprising:

a substrate layer having a first surface facing the particle source and a second surface facing the image receiving medium;

a spacer layer arranged on said first surface of the substrate layer;

depression areas arranged into a surface of the spacer layer facing the particle source;

a plurality of apertures, each of which is arranged through the printhead structure from a depression area of the spacer layer to the second surface of the substrate layer; and aperture controllers arranged in conjunction with the apertures to modulate streams of charged particles from the particle source through the apertures toward the image receiving medium.

11. An image recording apparatus as defined in claim 10, wherein the aperture controllers are embedded between the substrate layer and the spacer layer.

12. An image recording apparatus as defined in claim 10, wherein the particle source has an outer surface coated with a layer of charged particles, said outer surface of the particle source being caused to move in relation to the printhead structure in a predetermined first direction, and wherein a portion of said outer surface of the particle source extends adjacent to the spacer layer, in such a position that the layer of charged particles is pressed against the spacer layer, whereby only charged particles located in front of a depression area are allowed to be released from the outer surface of the particle sources.

13. An image recording apparatus as defined in claim 10, wherein the substrate layer is formed of a sheet of flexible, electrically insulating material.

14. An image recording apparatus as defined in claim 10, wherein the depression areas are obtained utilizing laser micromachining methods in which radiation is delivered on the first surface of the printhead, whereby an incident energy is absorbed in a thin layer which is decomposed, heated and ablated.

15. An image recording apparatus as defined in claim 10, wherein a depth of the depression areas with respect to the first surface of the printhead structure is in a range of 1 to 10 micrometers.

16. An image recording apparatus as defined in claim 10, wherein a material forming the spacer layer is harder than the charged particles.

17. An image recording apparatus as defined in claim 10, wherein the spacer layer is formed of a material having a friction coefficient sufficiently low to ensure uniform transport of the charged particles thereon.

18. An image recording apparatus which comprises:

at least one print station and an image receiving medium caused to move in relation to the print station, said print station including a particle source for delivering charged particles in a position adjacent to a printhead structure interposed between the particle source and the image receiving medium, said printhead structure comprising:

a first surface facing the particle source;

a second surface facing the image receiving medium;

a plurality of apertures arranged through the printhead structure; and control means arranged in conjunction with the apertures for modulating streams of charged particles from the particle source through the apertures toward the image receiving medium, wherein:

a part of the particle source is arranged adjacent to the first surface of the printhead structure; and depression areas are arranged into the first surface of the printhead structure such that at least a portion of each aperture is arranged in a depression area, said portion of the aperture being sunken with respect to a surrounding region of the first surface of the printhead structure and thereby spaced from the part of the particle source arranged adjacent to the first surface of the printhead structure.

* * * * *